US009373917B2

(12) United States Patent
Sypolt et al.

(10) Patent No.: US 9,373,917 B2
(45) Date of Patent: Jun. 21, 2016

(54) ELECTRICAL CONNECTOR HAVING A GROUNDING LATTICE

(71) Applicant: Tyco Electronics Corporation, Berwyn, PA (US)

(72) Inventors: Matthew Jeffrey Sypolt, Harrisburg, PA (US); Timothy Robert Minnick, Enola, PA (US); Margaret Mahoney Fernandes, West Chester, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/477,257

(22) Filed: Sep. 4, 2014

(65) Prior Publication Data

US 2016/0072231 A1 Mar. 10, 2016

(51) Int. Cl.
*H01R 13/6585* (2011.01)
*H01R 13/6461* (2011.01)
*H01R 13/6597* (2011.01)

(52) U.S. Cl.
CPC ..... *H01R 13/6585* (2013.01); *H01R 13/6461* (2013.01); *H01R 13/6597* (2013.01)

(58) Field of Classification Search
CPC ..... H01R 13/6587; H01R 13/688
USPC ..... 439/65, 607.05, 607.06, 607.07, 439/607.09, 607.11, 607.12, 66, 74
See application file for complete search history.

(56) References Cited

U.S. PATENT DOCUMENTS

| | | | | |
|---|---|---|---|---|
| 8,398,431 | B1 * | 3/2013 | Whiteman, Jr. .... | H01R 13/6587 439/607.06 |
| 8,419,472 | B1 * | 4/2013 | Swanger ..... | H01R 13/6587 439/607.07 |
| 8,465,323 | B2 | 6/2013 | Jeon | |
| 8,905,786 | B2 * | 12/2014 | Davis ..... | H01R 13/6587 439/108 |
| 2013/0178107 | A1 * | 7/2013 | Costello ..... | H01R 13/6585 439/628 |
| 2014/0080331 | A1 | 3/2014 | Jeon | |

* cited by examiner

*Primary Examiner* — Hae Moon Hyeon
*Assistant Examiner* — Marcus Harcum

(57) ABSTRACT

Electrical connector including a connector housing having a front side that faces along a mating axis and contact passages that open to the front side. The contact passages are configured to receive corresponding ground shields of a system connector during a mating operation. The electrical connector also includes signal contacts that are coupled to the connector housing and configured to engage corresponding contacts of the system connector. The electrical connector also includes a grounding lattice that is held by the connector housing. The grounding lattice includes a support frame and lattice springs that are interconnected by the support frame. The support frame extends generally transverse to the mating axis. The lattice springs are positioned to engage the ground shields of the system connector as the ground shields are inserted into the corresponding contact passages of the connector housing.

19 Claims, 10 Drawing Sheets

ELECTRICAL CONNECTOR HAVING A GROUNDING LATTICE

BACKGROUND

The subject matter herein relates generally to electrical connectors that have signal contacts and ground shields that electrically shield the signal contacts from one another.

Communication systems exist today that utilize electrical connectors to transmit large amounts of data at high speeds. For example, in a backplane communication system, a backplane circuit board interconnects a plurality of daughter card assemblies. The backplane circuit board includes an array of header connectors that mate with corresponding receptacle connectors of the daughter card assemblies. The receptacle connectors are mounted to a daughter card of the corresponding daughter card assembly. The header and receptacle connectors include complementary arrays of electrical contacts. In some systems, the header connector includes signal contacts and ground shields that are positioned between, for example, pairs of the signal contacts. The receptacle connector includes signal contacts and corresponding ground contacts. During the mating operation, the signals contacts of the header and receptacle connectors engage one another to form signal pathways between the header and receptacle connectors. The ground contacts of the receptacle connector engage the ground shields of the header connector.

There has been a general demand to increase the density of signal contacts and increase the speeds at which data is transmitted through the communication systems. Consequently, it has been more challenging to maintain a baseline level of signal quality. For example, in some cases, the electrical energy that flows through each ground shield of the header connector may be reflected and resonate within the respective ground shield. The electrical energy may radiate from one ground shield and couple with nearby ground shields thereby causing electrical noise. Depending on the frequency of the crosstalk noise, the crosstalk noise can reduce signal quality.

Accordingly, there is a need for electrical connectors that reduce the electrical noise caused by separate ground shields.

BRIEF DESCRIPTION

In an embodiment, an electrical connector is provided that includes a connector housing having a front side that faces along a mating axis and contact passages that open to the front side. The contact passages are configured to receive corresponding ground shields of a system connector during a mating operation. The electrical connector also includes signal contacts that are coupled to the connector housing and configured to engage corresponding contacts of the system connector. The electrical connector also includes a grounding lattice that is held by the connector housing. The grounding lattice includes a support frame and lattice springs that are interconnected by the support frame. The support frame extends generally transverse to the mating axis. The lattice springs are positioned to engage the ground shields of the system connector as the ground shields are inserted into the corresponding contact passages of the connector housing.

In some embodiments, the connector housing has a loading side that is generally opposite the front side. The grounding lattice may be located within the connector housing between the front and loading sides. Optionally, the connector housing includes a cover portion and a base portion that are separable from each other. The cover portion may include the front side, wherein the grounding lattice is positioned between the cover and base portions.

In some embodiments, the contact passages form a two-dimensional passage array. The grounding lattice is configured to electrically ground a two-dimensional shield array of the ground shields when the electrical connector and the system connector are mated.

In an embodiment, a communication system is provided that includes a first electrical connector having a contact array including first signal contacts and ground shields that are positioned between the first signal contacts. The communication system also includes a second electrical connector having a connector housing with a front side that faces along a mating axis and contact passages that open to the front side. The second electrical connector also includes second signal contacts and a grounding lattice that is held by the connector housing. The grounding lattice extends generally transverse to the mating axis. The first signal contacts and the second signal contacts engage one another when the first and second electrical connectors are mated to establish signal pathways. The ground shields are received within the contact passages and shield the signal pathways from one another. The grounding lattice engages the ground shields to electrically common the ground shields. Optionally, the ground shields may be electrically commoned along two perpendicular axes.

In some embodiments, the ground shields include shield bodies that have respective body lengths measured along the mating axis. Each of the body lengths is measured between a leading edge and a trailing edge of the corresponding shield body. As one example, the grounding lattice may engage the shield bodies within a middle one-half (½) of the body length. However, the grounding lattice may engage the shield bodies at other locations.

In an embodiment, an electrical connector is provided that includes a connector housing having a front side and contact passages that open to the front side. The contact passages configured to receive corresponding ground shields of a system connector during a mating operation. The electrical connector also includes contact sub-assemblies having signal contacts and ground contacts. The signal contacts are configured to engage corresponding contacts of the system connector. The ground contacts are positioned within corresponding contact passages and configured to engage the corresponding ground shields during the mating operation. Each of the contact sub-assemblies includes a pair of the signal contacts and at least one of the ground contacts that is positioned adjacent to the pair of the signal contacts. The electrical connector also includes a grounding lattice held by the connector housing and extending generally parallel to the front side. The grounding lattice engages the corresponding ground shields within the corresponding contact passages when the system connector and the electrical connector are mated to electrically common the ground shields.

DETAILED DESCRIPTION

Embodiments set forth herein may include electrical connectors and communication systems having the electrical connectors. Although the illustrated embodiment includes electrical connectors that are used in high-speed communication systems, such as backplane or midplane communication systems, it should be understood that embodiments may be used in other communication systems or in other systems/devices that utilize electrical contacts. In the illustrated embodiment, the electrical connectors are referred to as header connectors and receptacle connectors. Embodiments, however, may include other types of electrical connectors. Accordingly, the inventive subject matter is not limited to the illustrated embodiment.

Figure 1:
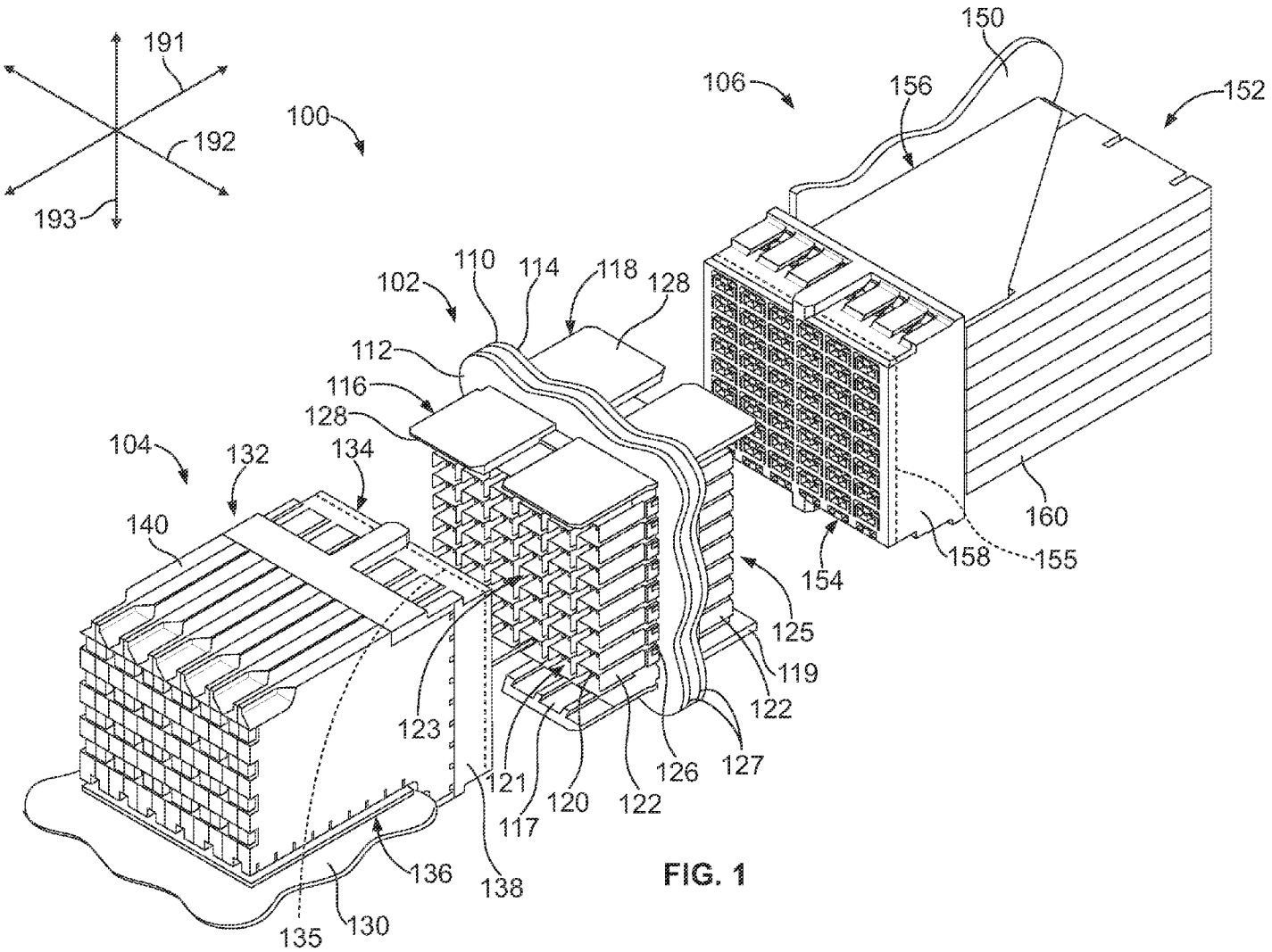
FIG. 1 is a perspective view of a communication system formed in accordance with an embodiment.

FIG. 1 is a perspective view of a communication system 100 formed in accordance with an embodiment. For reference, the communication system 100 is oriented with respect to mutually perpendicular axes 191, 192, 193, including a mating axis 191, a first lateral axis 192, and a second lateral axis 193. The communication system 100 includes a circuit board assembly 102, a first connector system (or assembly) 104 configured to be coupled to one side of the circuit board assembly 102, and a second connector system (or assembly) 106 configured to be coupled to an opposite side the circuit board assembly 102. The circuit board assembly 102 is used to electrically connect the first and second connector systems 104, 106. Optionally, the first and second connector systems 104, 106 may be daughter card assemblies, such as line card assemblies or switch card assemblies. Although the communication system 100 is configured to interconnect two connector systems in the illustrated embodiment, other communication systems may interconnect more than two connector systems. Also, in the illustrated embodiment, the connector systems 104, 106 are located on opposite sides of the circuit board assembly 102. In other embodiments, the connector system 104, 106 may be located on the same side.

The circuit board assembly 102 includes a circuit board 110 having a first board side 112 and second board side 114. In some embodiments, the circuit board 110 may be a backplane circuit board, a midplane circuit board, or a motherboard. The circuit board assembly 102 includes a first header connector 116 mounted to and extending from the first board side 112 of the circuit board 110. The circuit board assembly 102 may also include a second header connector 118 mounted to and extending from the second board side 114 of the circuit board 110. The first and second header connectors 116, 118 include connector housings 117, 119, respectively. The first and second header connectors 116, 118 include contact arrays 123, 125, respectively, that each include electrical contacts 120, 122. The electrical contacts 120, 122 include signal contacts 120 and ground shields (or contacts) 122. In the illustrated embodiment, the contact arrays 123, 125 are two-dimensional arrays that extend along the first and second lateral axes 192, 193. The contact arrays 123, 125 form multiple columns (or rows).

The circuit board assembly 102 includes a plurality of signal paths (not shown) therethrough defined by the signal contacts 120 and conductive vias 170 (shown in FIG. 2) that extend through the circuit board 110. The signal contacts 120 of the first and second header connectors 116, 118 are electrically coupled to one another. The signal contacts 120 of the first and second header connectors 116, 118 may be received in the same conductive vias 170 to define signal paths directly through the circuit board 110. Alternatively, the signal contacts 120 of the first header connector 116 and the signal contacts 120 of the second header connector 118 may be inserted into different conductive vias 170 that are electrically coupled to one another through traces (not shown) of the circuit board 110.

The ground shields 122 provide electrical shielding around corresponding signal contacts 120. In an exemplary embodiment, the signal contacts 120 are arranged in signal pairs 121 and are configured to convey differential signals. Each of the ground shields 122 may peripherally surround a corresponding signal pair 121. As shown, the ground shields 122 are C-shaped or U-shaped and cover the corresponding signal pair 121 along three sides. The ground shields 122 may be electrically coupled to one or more ground planes 127 of the circuit board 110. The ground planes 127 may be conductive layers that electrically common (or couple) the ground shields 122 to one another.

The connector housings 117, 119 couple to and hold the signal contacts 120 and the ground shields 122 in designated positions relative to each other. The connector housings 117, 119 may be manufactured from a dielectric material, such as a plastic material. Each of the connector housings 117, 119 includes a mounting wall 126 that is configured to be mounted to the circuit board 110 and shroud walls 128 that extend from the mounting wall 126.

The first connector system 104 includes a first circuit board 130 and a first receptacle connector 132 that is mounted to the first circuit board 130. The first receptacle connector 132 is configured to be coupled to the first header connector 116 of the circuit board assembly 102 during a mating operation. The first receptacle connector 132 has a front side 134 that is configured to be mated with the first header connector 116. The first receptacle connector 132 has a board interface 136 configured to be mated with the first circuit board 130. In an exemplary embodiment, the board interface 136 is oriented perpendicular to the front side 134. When the first receptacle connector 132 is coupled to the first header connector 116, the first circuit board 130 is oriented perpendicular to the circuit board 110.

The first receptacle connector 132 includes a connector housing or shroud 138. The connector housing 138 is configured to hold a plurality of contact modules 140 side-by-side. As shown, the contact modules 140 are held in a stacked configuration generally parallel to one another. In some embodiments, the contact modules 140 hold a plurality of signal conductors (not shown) that are electrically connected to the first circuit board 130. The signal conductors are configured to engage the signal contacts 120 of the first header connector 116 when the first header connector 116 and the first receptacle connector 132 are mated.

The second connector system 106 includes a second circuit board 150 and a second receptacle connector 152 coupled to the second circuit board 150. The second receptacle connector 152 is configured to be coupled to the second header connector 118 during a mating operation. The second receptacle connector 152 has a front side 154 configured to be mated with the second header connector 118. The second receptacle connector 152 has a board interface 156 configured to be mated with the second circuit board 150. In an exemplary embodiment, the board interface 156 is oriented perpendicular to the front side 154. When the second receptacle connector 152 is coupled to the second header connector 118, the second circuit board 150 is oriented perpendicular to the circuit board 110.

Similar to the first receptacle connector 132, the second receptacle connector 152 includes a connector housing or shroud 158 used to hold a plurality of contact modules 160. The contact modules 160 are held in a stacked configuration generally parallel to one another. The contact modules 160 hold a plurality of signal conductors 162 (shown in FIGS. 3 and 4) that are electrically connected to the second circuit board 150. The signal conductors 162 are configured to engage the signal contacts 120 of the second header connector 118. The signal conductors 162 of the contact modules 160 may be similar or identical to the signal conductors (not shown) of the first receptacle connector 132.

In the illustrated embodiment, the first circuit board 130 is oriented generally horizontally. The contact modules 140 of the first receptacle connector 132 are oriented generally vertically. The second circuit board 150 is oriented generally vertically. The contact modules 160 of the second receptacle connector 152 are oriented generally horizontally. In such configurations, the first connector system 104 and the second connector system 106 may have an orthogonal orientation with respect to one another.

The first and second receptacle connectors 132, 152 may include grounding lattices 135, 155, respectively, held by the connector housings 138, 158, respectively. The grounding lattices 135, 155 are indicated by dashed lines in FIG. 1 because the grounding lattices 135, 155 are located within the respective connector housings 138, 158. In alternative embodiments, the grounding lattices 135, 155 may be positioned directly along the corresponding front sides 134, 154. In alternative embodiments, the grounding lattices 135, 155 may be positioned directly along internal loading sides (not shown) of the connector housings 138, 158, respectively, that interface with the corresponding contact modules 140, 160.

Figure 4:
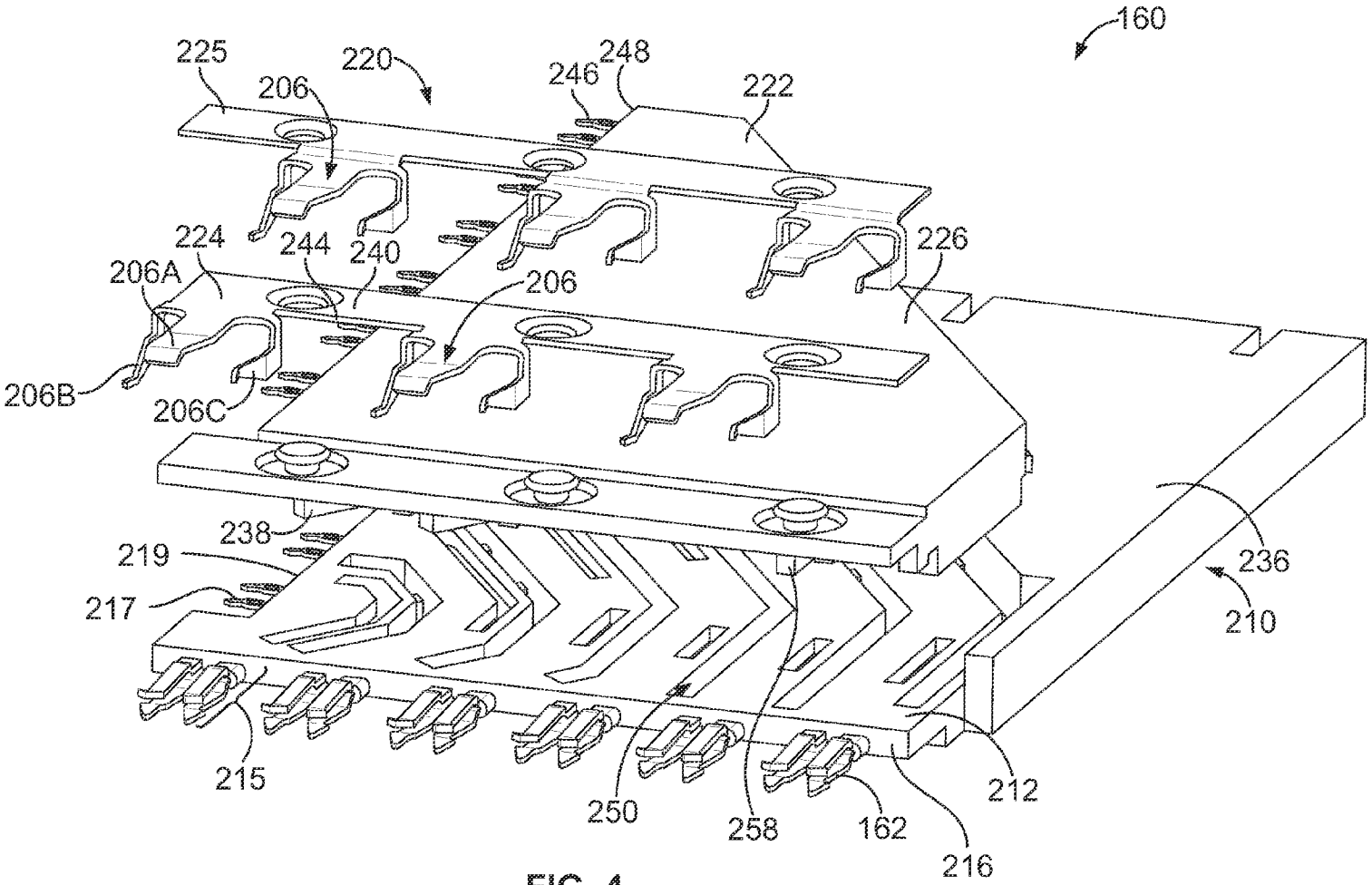
FIG. 4 is an exploded view of a contact module for the receptacle connector shown in FIG. 3.
Figure 5:
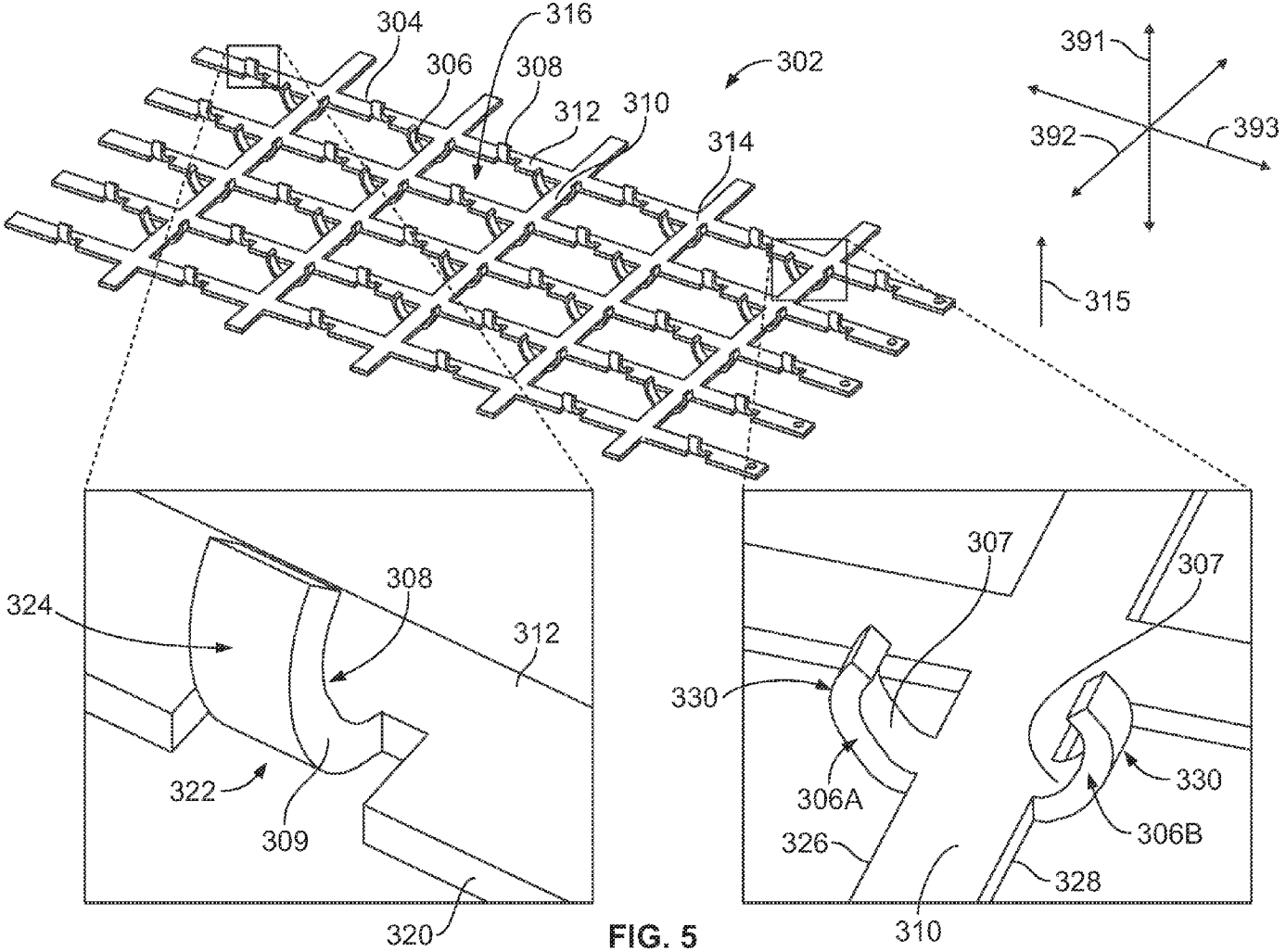
FIG. 5 illustrates a perspective view of a grounding lattice in accordance with an embodiment that may be used with a receptacle connector of a communication system.

The grounding lattices 135, 155 may be similar or identical to the grounding lattice 302 (shown in FIG. 5). In particular embodiments, the grounding lattices 135, 155 may be encased within a dielectric material of the corresponding connector housings 138, 158 and/or surrounded by an air dielectric such that the grounding lattices 135, 155 are electrically isolated from other conductive elements of the respective receptacle connectors 132, 152. In other embodiments, however, the grounding lattices 135, 155 may be electrically coupled to shield assemblies of the first and second receptacle connectors 132, 152, respectively, such as the shield assembly 220 (shown in FIG. 4). The grounding lattices 135, 155 are configured to engage the ground shields 122 of the respective header connectors 116, 118. More specifically, the separate ground shields 122 of the first header connector 116 may be electrically commoned by the grounding lattice 135 of the first receptacle connector 132, and the separate ground shields 122 of the second header connector 118 may be electrically commoned by the grounding lattice 155 of the second receptacle connector 152. In some embodiments, electrical noise generated by the ground shields 122 may be reduced by the grounding lattices 135, 155.

Figure 2:
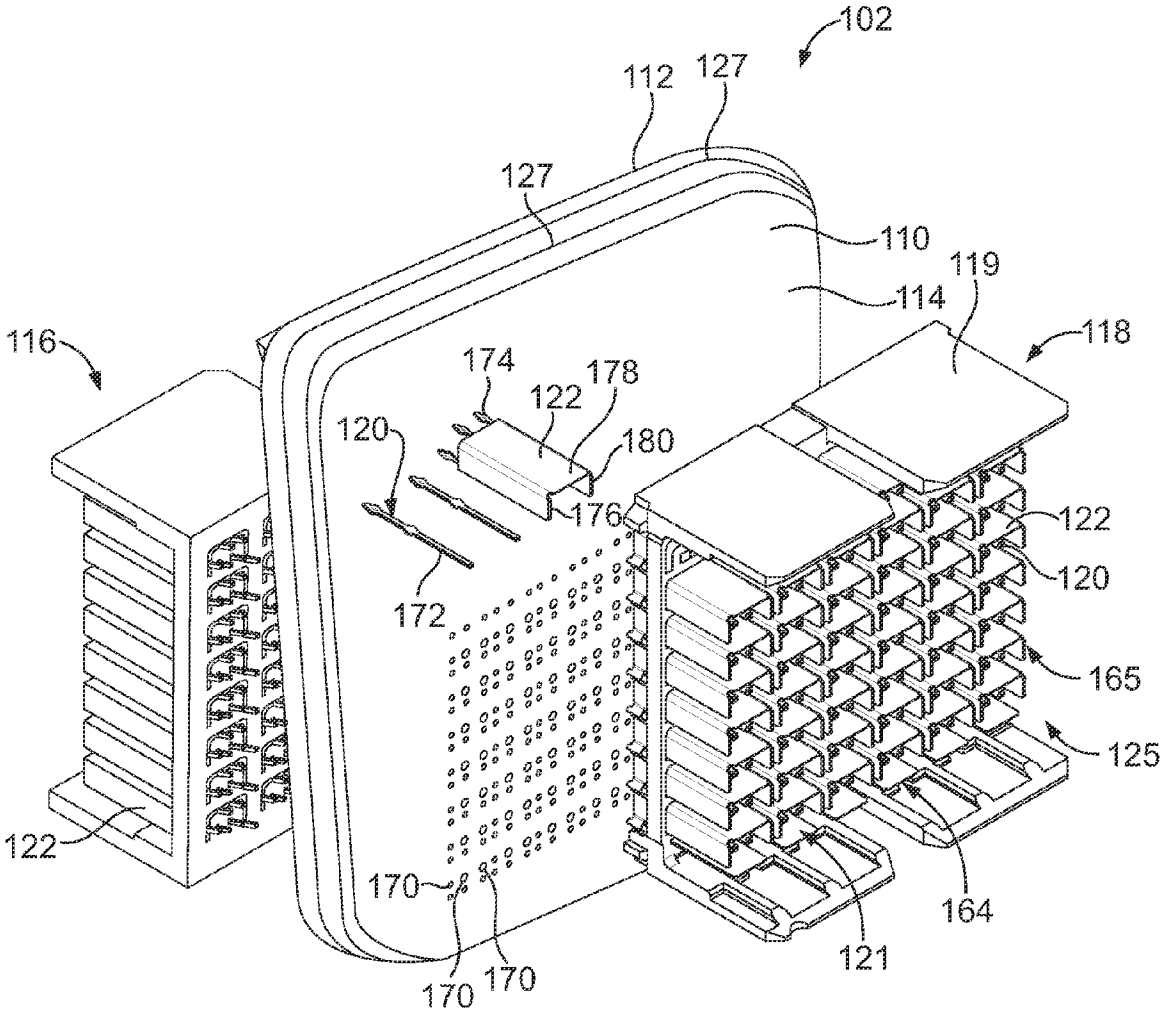
FIG. 2 is a perspective view of a circuit board assembly including a header connector that may be used with the communication system of FIG. 1.

FIG. 2 is a partially exploded view of the circuit board assembly 102 showing the first and second header connectors 116, 118 positioned for mounting to the circuit board 110. Although the following description is with respect to the second header connector 118, the description is also applicable to the first header connector 116. As shown, the connector housing 119 includes a receiving space 164 that opens away from the second board side 114 of the circuit board 110. The receiving space 164 is configured to receive the second receptacle connector 152 (FIG. 1) during a mating operation. The contact array 125 is also shown and includes the signal contacts 120 and the ground shields 122. The signal contacts 120 are arranged in multiple signal pairs 121. The ground shields 122 form a two-dimensional shield array (or sub-array) 165 of the contact array 125. The ground shields 122 of the two-dimensional shield array 165 may be electrically commoned by the grounding lattice 155 (FIG. 1).

The conductive vias 170 extend into the circuit board 110. In an exemplary embodiment, the conductive vias 170 extend entirely through the circuit board 110 between the first and second board sides 112, 114. In other embodiments, the conductive vias 170 extend only partially through the circuit board 110. The conductive vias 170 are configured to receive the signal contacts 120 of the first and second header connectors 116, 118. For example, the signal contacts 120 include compliant pins 172 that are configured to be loaded into corresponding conductive vias 170. The compliant pins 172 mechanically engage and electrically couple to the conductive vias 170. Likewise, at least some of the conductive vias 170 are configured to receive compliant pins 174 of the ground shields 122. The compliant pins 174 mechanically and electrically couple to the conductive vias 170. The conductive vias 170 that receive the compliant pins 174 may be electrically coupled to the ground planes 127.

The ground shields 122 are C-shaped and provide shielding on three sides of the signal pair 121. The ground shields 122 have a plurality of shield walls, such as three shield walls 176, 178, 180. The shield walls 176, 178, 180 may be integrally formed or alternatively, may be separate pieces. The compliant pins 174 extend from each of the shield walls 176, 178, 180 to electrically connect the shield walls 176, 178, 180 to the circuit board 110. The shield wall 178 defines a center wall or top wall of the ground shield 122. The shield walls 176, 180 define side walls that extend from the shield wall 178. The shield walls 176, 180 may be generally perpendicular to the shield wall 178. The grounding lattice 155 (FIG. 1) may engage one or more of the shield walls 176, 178, 180. Other configurations or shapes for the ground shields 122, however, are possible in alternative embodiments. For example, more or fewer walls may be provided in other embodiments. Also, the walls may be bent or angled rather than being planar in other embodiments.

Figure 3:
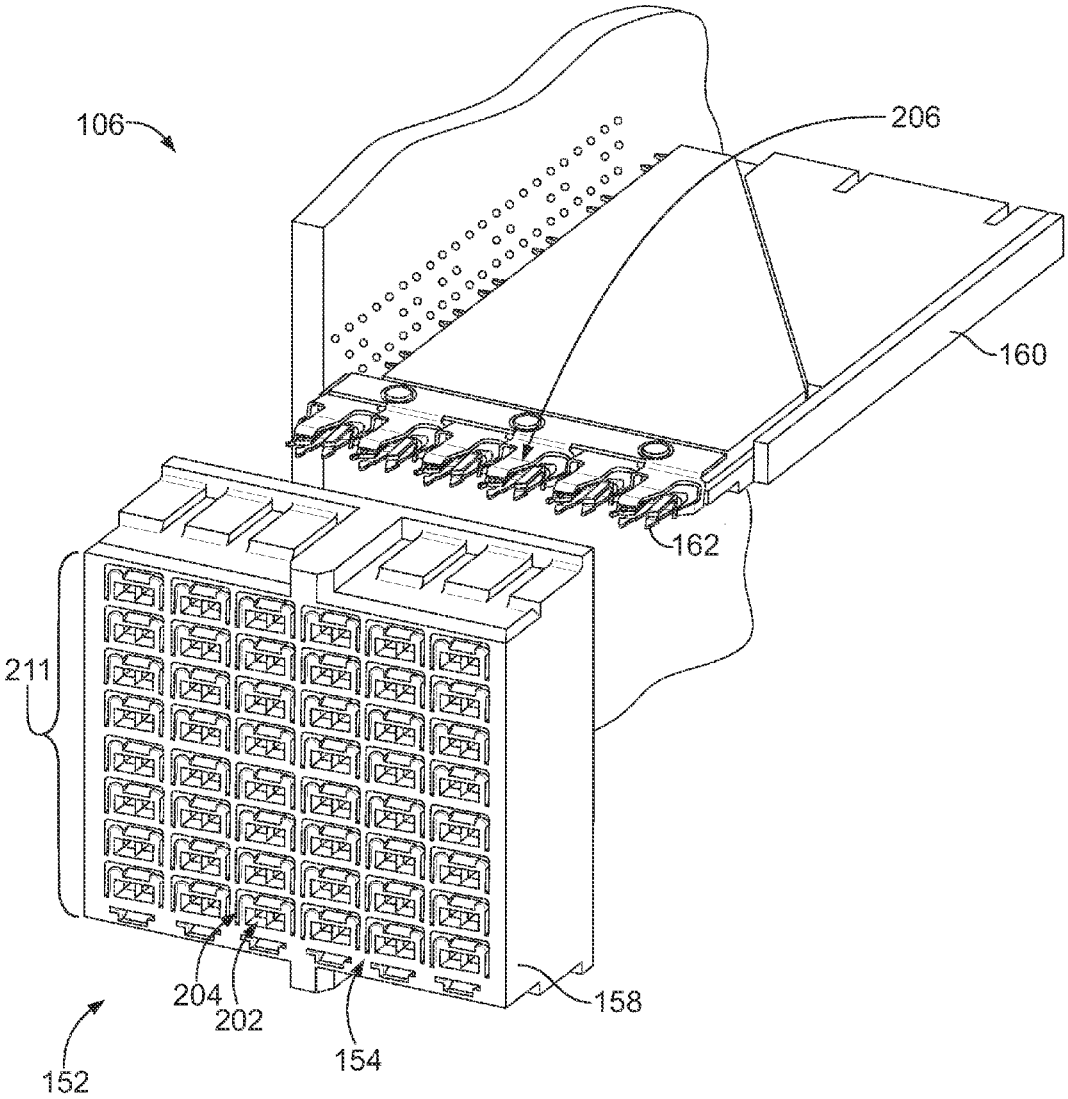
FIG. 3 is a partially exploded view of a portion of a receptacle connector that may be used with the communication system of FIG. 1.

FIG. 3 is a front perspective view of a portion of the second receptacle connector 152 showing one of the contact modules 160 poised for loading into the connector housing 158. The connector housing 158 includes a plurality of contact passages 202, 204 that open to the front side 154 of the connector housing 158. The contact passages 202, 204 are hereinafter referred to as signal passages 202 and ground passages 204. The signal and ground passages 202, 204 form a two-dimensional passage array 211.

When the second receptacle connector 152 is fully assembled, the signal conductors 162 and ground contacts 206 of the contact modules 160 are coupled to the connector housing 158. The coupling may be direct, such that the connector housing 158 directly engages the ground contacts 206 and/or the signal conductors 162. Alternatively, the connector housing 158 may indirectly couple to the ground contacts 206 and/or the signal conductors 162. For example, the ground contacts 206 and/or the signal conductors 162 may be held by the contact modules 160, which are secured to the connector housing 158.

The contact module 160 is coupled to the connector housing 158 such that the signal conductors 162 are received in corresponding signal passages 202. Optionally, a single signal conductor 162 is received in each signal passage 202. The signal passages 202 are also configured to receive corresponding signal contacts 120 (FIG. 1) of the second header connector 118 (FIG. 1) therein. The ground passages 204 are configured to receive corresponding ground shields 122 (FIG. 1) therein. When the second receptacle connector 152 is fully assembled, the ground passages 204 may provide access to the ground contacts 206 of the contact modules 160 such that the ground shields 122 may engage the ground contacts 206 within the connector housing 158. The ground contacts 206 may engage with the ground shields 122 to electrically common the receptacle and header assemblies 152, 118.

The connector housing 158 is manufactured from a dielectric material, such as a plastic material, and may provide separation between the signal passages 202 and the ground passages 204. The ground passages 204 are C-shaped in the illustrated embodiment to receive the C-shaped ground shields 122 (FIG. 1). Other shapes are possible in alternative embodiments. The ground passages 204 may be chamfered at the front side 154 to guide the ground shields 122 into the ground passages 204 during mating. The signal passages 202 are chamfered at the front side 154 to guide the signal contacts 120 into the signal passages 202 during mating.

FIG. 4 is an exploded view of the contact module 160. The contact module 160 includes a frame assembly 210, which includes the signal conductors 162. The signal conductors 162 are arranged in pairs for carrying differential signals. In an exemplary embodiment, the frame assembly 210 includes a dielectric frame 212 that surrounds the signal conductors 162. The signal conductors 162 include signal contacts 215 that project from a front edge 216 of the dielectric frame 212 and mounting tails 217 that project from a mounting edge 219. The signal conductors 162 extend between the signal contacts 215 and the mounting tails 217. Optionally, the dielectric frame 212 may be overmolded over the signal conductors 162. The signal conductors 162 may form part of a leadframe that is overmolded to encase portions of the signal conductors 162.

The contact module 160 includes a shield assembly 220 that provides shielding for the signal conductors 162. In an exemplary embodiment, the shield assembly 220 is located between pairs of the signal conductors 162 to provide shielding between each of the pairs of signal conductors 162. The shield assembly 220 includes a side shell 222 and one or more ground clips 224, 225 that are coupled to the side shell 222. The side shell 222 has a main body 226 that is generally planar and extends along a first side 236 of the dielectric frame 212. The side shell 222 includes ground tabs 238 extending (e.g. downward) from the main body 226. The ground tabs 238 are configured to be received in corresponding trenches 250 of the dielectric frame 212 such that the ground tabs 238 are located between adjacent pairs of signal conductors 162. The ground tabs 238 and side shell 222 together define a C-shaped shield structure that surrounds each pair of signal conductors 162 on three sides.

The ground clips 224, 225 are mounted to a front of the side shell 222. The ground clips 224, 225 are similar to one another and only the ground clip 224 is described in detail below. The ground clip 224 includes a base 240 and ground contacts 206 extending from a front edge 244 of the base 240. The ground contacts 206 are configured to extend into the ground passages 204 (FIG. 3). The ground contacts 206 are configured to engage and be electrically connected to the ground shields 122 (FIG. 1) when the contact module 160 is loaded into the connector housing 158 (FIG. 1) and when the second receptacle connector 152 is coupled to the second header connector 118 (FIG. 1). The ground contacts 206 may be deflectable.

In the illustrated embodiment, the ground clip 224 includes a central ground contact 206A and a pair of side ground contacts 206B, 206C. The central ground contacts 206A are configured to be positioned above the pairs of signal conductors 162. The side ground contacts 206B, 206C are configured to be positioned between pairs of the signal conductors 162 that are held by the same dielectric frame 212. The side ground contacts 206B, 206C provide shielding along sides of the signal contacts 215 of the signal conductors 162. The ground contacts 206A, 206B, 206C provide shielding on three sides of each pair of signal conductors 162.

In an exemplary embodiment, the ground clips 224, 225 are mounted to the side shell 222 with the ground clip 225 stacked on the ground clip 224. The ground contacts 206 of the ground clip 225 are laterally offset from the ground contacts 206 of the ground clip 204 such that the ground contacts 206 of both ground clips are interleaved when the ground clips 224, 225 are stacked. The ground contacts 206 of each ground clip 224, 225 provide shielding around successive, alternating pairs of signal conductors 162. In an exemplary embodiment, the ground clips 224, 225 are stamped and formed.

The shield assembly 220 may include ground pins 246 extending from a bottom 248 of the side shell 222. The ground pins 246 may be compliant pins. The ground pins 246 are configured to be received in corresponding conductive vias in the second circuit board 150. Optionally, the ground pins 246 may be integrally formed with the side shell 222. In an alternative embodiment, a separate clip or bar may be coupled to the bottom 248 of the side shell 222 that includes the ground pins 246.

FIG. 5 is a perspective view of a grounding lattice 302 in accordance with an embodiment. The grounding lattice 302 is oriented with respect to mutually perpendicular axes 391, 392, 393, including a mating axis 391, a first lateral axis 392, and a second lateral axis 393. The grounding lattice 302 may be similar or identical to the grounding lattices 135, 155 (FIG. 1). Like the grounding lattices 135, 155, the grounding lattice 302 may be configured to electrically common separate ground structures or shields of an electrical connector. The grounding lattice 302 includes a support frame 304 and lattice springs 306, 308 that are interconnected by the support frame 304. The lattice springs 306, 308 include side lattice springs 306 and wall lattice springs 308. The support frame 304 includes first links 310 that have corresponding side lattice springs 306, and second links 312 that have corresponding wall lattice springs 308. The first and second links 310, 312 couple to each other at corresponding intersections 314. As shown, the first links 310 extend parallel to the first lateral axis 392, and the second links 312 extend parallel to the second lateral axis 393.

The first and second links 310, 312 form a grid or web-like pattern that includes a plurality of openings 316 therethrough. Each opening 316 is sized and shaped to permit a ground shield 410 (shown in FIG. 10) to be received therethrough.

The ground shield 410 may be similar or identical to the ground shield 122 (FIG. 1). In an exemplary embodiment, when the ground shields 410 extend through the corresponding openings 316 along the mating axis 391, each of the ground shields 410 engages two of the side lattice springs 306 and one of the wall lattice springs 308. In alternative embodiments, there may be a different number of lattice springs such that the ground shields 410 engage less than three lattice springs or more than three lattice springs.

The grounding lattice 302 may be stamped and formed from a conductive material, such as sheet metal. Alternatively, the grounding lattice 302 may include a dielectric frame (e.g., plastic body) that is plated with a conductive material. For example, the grounding lattice 302 may be 3D-printed using a conductive material or 3D-printed using a dielectric frame that is subsequently plated with conductive material. The support frame 304 is substantially planar and extends parallel to a plane defined by the first and second lateral axes 392, 393. The support frame 304 extends transverse or orthogonal to the mating axis 391. In alternative embodiments, the support frame 304 is not planar. For example, the first and second links 310, 312 may include segments that extend parallel to the mating axis 391. The first and second links 310, 312 may also have curved contours in other embodiments.

In the illustrated embodiment, the side lattice springs 306 and the wall lattice springs 308 extend away from the support frame 304 in a mating direction 315 that is generally parallel to the mating axis 391. In other embodiments, one or more of the side lattice springs 306 and/or one or more of the wall lattice springs 308 may extend in an opposite direction along the mating axis 391. Each wall lattice spring 308 is approximately located at a midpoint of the corresponding link 310. In alternative embodiments, the wall lattice springs 308 may have different locations. The side lattice springs 306 may also have different locations than those shown in FIG. 5.

Figure 10:
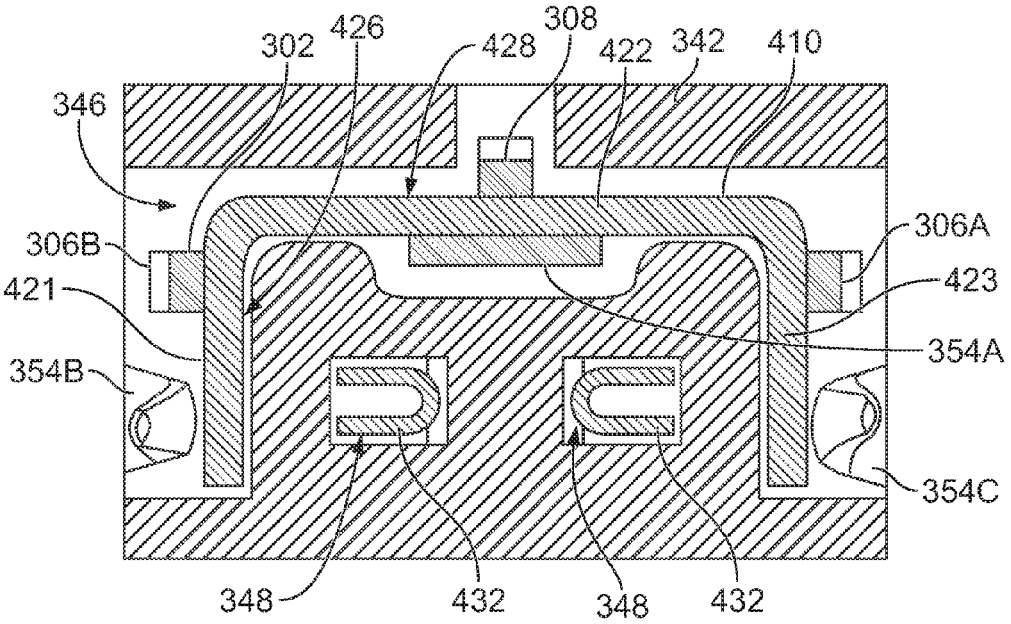
FIG. 10 is a cross-sectional view of a contact sub-assembly of the receptacle connector engaged with corresponding contacts of a header connector.

FIG. 5 also includes an enlarged view of a pair of side lattice springs 306A, 306B and an enlarged view of one of the wall lattice springs 308. The wall lattice spring 308 extends from an edge 320 of the corresponding second link 312. The edge 320 may be shaped to form a spring recess 322. The wall lattice spring 308 includes an elongated body 309 having a curved contour that initially extends away from the edge 320 and then extends generally along the mating axis 391. The wall lattice spring 308 includes an inflection area 324 that is configured to directly engage the corresponding ground shield 410 (FIG. 10). The inflection area 324 and the curved elongated body 309 of the wall lattice spring 308 may be configured to reduce the likelihood of the ground shield 410 stubbing or snagging the wall lattice spring 308 during a mating operation. The inflection area 324 is configured to be positioned within a path of the ground shield 410 such that the ground shield 410 engages the wall lattice spring 308.

The side lattice springs 306A, 306B may have similar configurations as the wall lattice springs 308. The side lattice springs 306A, 306B include respective elongated bodies 307 that project in opposite directions from a common first link 310. The common first link 310 includes opposite edges 326, 328. The side lattice springs 306A, 306B extend in opposite directions away from the edges 326, 328, respectively. The side lattice springs 306A, 306B are configured to engage different ground shields 410 that are separated by the common first link 310.

The elongated bodies 307 of the corresponding side lattice springs 306A, 306B may have a similar curved contour as the elongated body 309 of the wall lattice spring 308 and include respective inflections areas 330. The inflection areas 330 of the side lattice springs 306A, 306B generally face in opposite directions. Like the inflection area 324, the inflection areas 330 are configured to be positioned within paths of the corresponding ground shields 410 such that the ground shields 410 engage the respective side lattice springs 306A, 306B. Although the side lattice springs 306A, 306B are shown in FIG. 5 as being generally opposite each other, the side lattice springs 306A, 306B may have different locations along the common first link 310.

Figure 6:
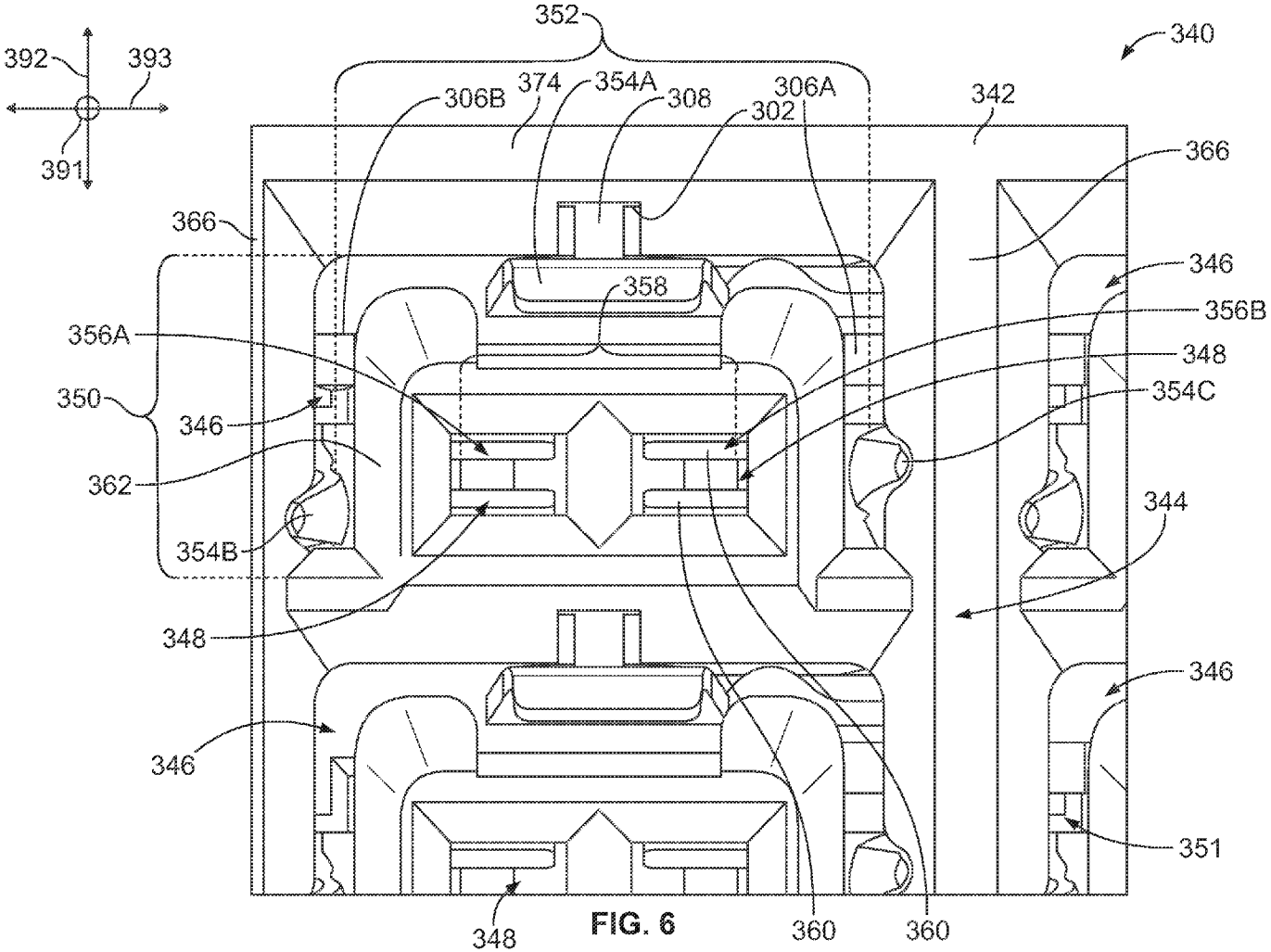
FIG. 6 is an enlarged plan view of a receptacle connector in accordance with an embodiment that includes the grounding lattice of FIG. 5.

FIG. 6 is an enlarged end view of a receptacle connector 340 formed in accordance with an embodiment that includes the grounding lattice 302. The receptacle connector 340 may be similar or identical to the first receptacle connector 132 (FIG. 1) or the second receptacle connector 152 (FIG. 1). The receptacle connector 340 is configured to mate with a system connector 402 (shown in FIG. 11), which may be similar or identical to the first header connector 116 (FIG. 1) or the second header connector 118 (FIG. 1).

The receptacle connector 340 includes a connector housing 342 having a front side 344 that includes contact passages 346, 348 that open to the front side 344. The front side 344 extends generally parallel to the first and second lateral axes 392, 393 and perpendicular to the mating axis 391. The contact passages 346, 348 are hereinafter referred to as ground passages 346 and signal passages 348. It should be understood that embodiments may include various combinations or groupings of signal and ground passages. For example, in the illustrated embodiment, a single ground passage 346 partially surrounds a pair of the signal passages 348 to form a passage group 350. The signal passages 348 of a passage group 350 are defined within a common dielectric block 362 of the connector housing 342. The ground passage 346 of the passage group 350 is defined between the dielectric block 362 and housing walls 366, 374. The housing walls 366 extend along the first lateral axis 392, and the housing wall 374 extends along the second lateral axis 393. The ground passages 346 and the signal passages 348 (or the passage groups 350) form a two-dimensional passage array 351. In alternative embodiments, each passage group 350 may include more than one ground passage and/or only one signal passage.

It should also be understood that embodiments may have signal and ground passages that have different shapes than those shown in FIG. 6. For example, in the illustrated embodiment, each ground passage 346 is C-shaped or U-shaped and partially surrounds the pair of the signal passages 348. In alternative embodiments, the ground passages 346 may have different shapes. Furthermore, it should be understood that different passages may not be entirely separate. For example, although the ground passages 346 appear to be separate in FIG. 6, adjacent ground passages 346 may extend into a common contact cavity 364 (shown in FIG. 7).

The receptacle connector 340 includes contact sub-assemblies 352. Each of the contact sub-assemblies 352 may include ground contacts 354A, 354B, 354C and signal contacts 356A, 356B. The ground contact 354A may be termed the central ground contact, and the ground contacts 354B, 354C may be termed the side ground contacts. The ground contacts 354A-354C are positioned within the same ground passage 346, but the signal contacts 356A, 356B are positioned in different signal passages 348. The ground contacts 354A-354C may be similar to the ground contacts 206A-206C shown in FIG. 4. The signal contacts 356A, 356B may be similar to the signal contacts 215 shown in FIG. 4. As shown in FIG. 6, the signal contacts 356A, 356B form a signal pair 358, and each of the signal contacts 356A, 356B includes a pair of beams 360 that are, for example, stamped from a common piece of sheet metal. The ground contacts 354A-354C are positioned to surround the corresponding signal pair 358.

Figure 11:
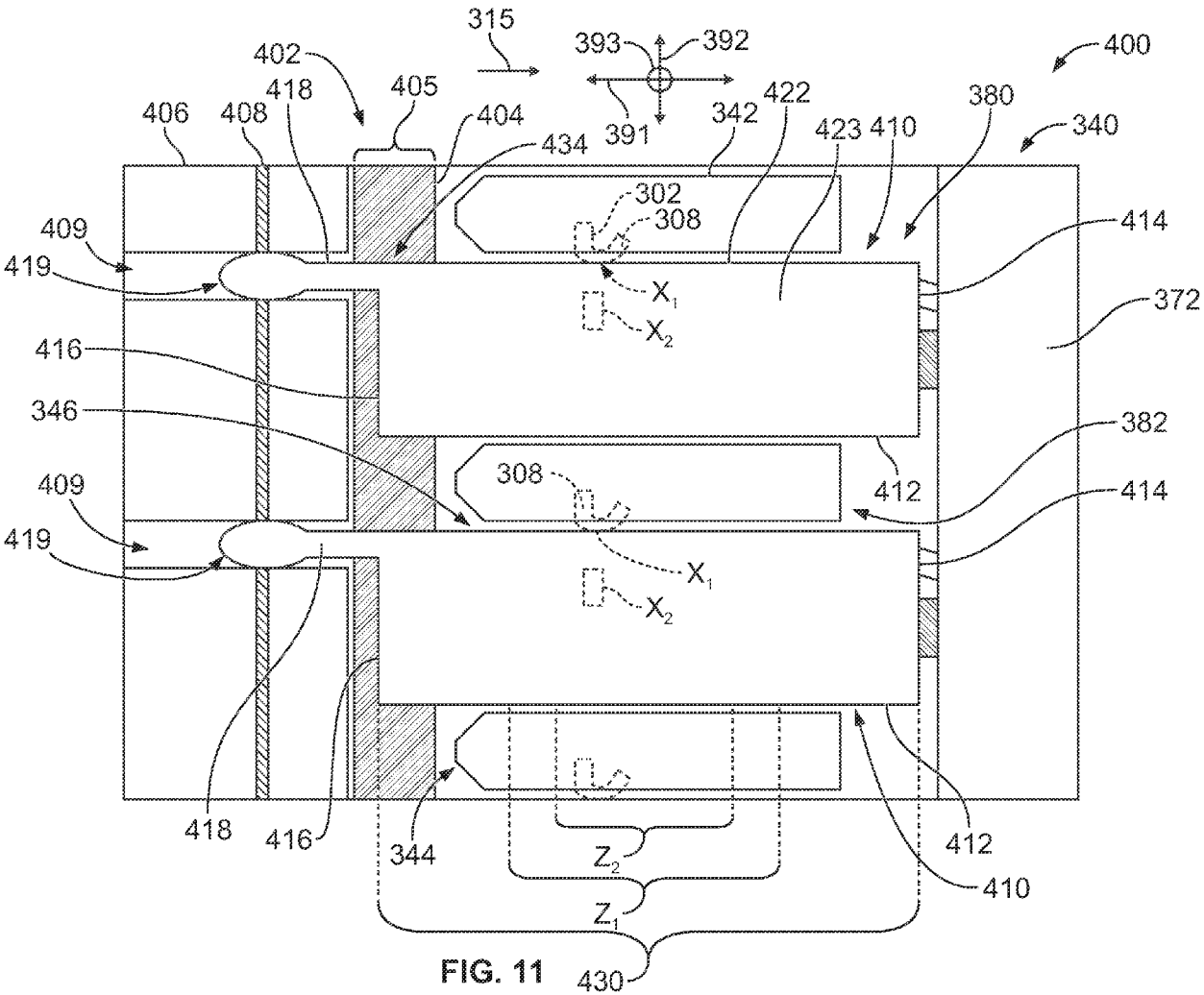
FIG. 11 is a side cross-sectional view of the communication system when the receptacle and header connectors are mated.

Each of the signal passages 348 is shaped to receive a corresponding signal contact 432 (shown in FIG. 10) of the system connector 402 (shown in FIG. 11). The signal passages 348 are aligned with the signal contacts 356A, 356B, respectively, such that the corresponding signal contacts 432 of the system connector 402 engage the signal contacts 356A, 356B during the mating operation.

The ground passage 346 is shaped to receive a corresponding ground shield 410 (shown in FIG. 10) of the system connector 402 (FIG. 11). The ground passage 346 is aligned with the ground contacts 354A-354C, the side lattice springs 306A, 306B, and the wall lattice spring 308. The side lattice springs 306A, 306B are coupled to different corresponding first links 310 (FIG. 5). When the ground shield 410 is inserted into the ground passage 346, the ground shield 410 engages each of the ground contacts 354A-354C, the side lattice springs 306A, 306B, and the wall lattice spring 308. The ground contacts 354A-354C electrically couple the ground shield 410 to a shield assembly (not shown) of the receptacle connector 340. The shield assembly may be similar to the shield assembly 220 (FIG. 4). The side lattice springs 306A, 306B and the wall lattice spring 308, on the other hand, electrically couple the ground shields 410 of the system connector 402 to one another through the grounding lattice 302.

Figure 8:
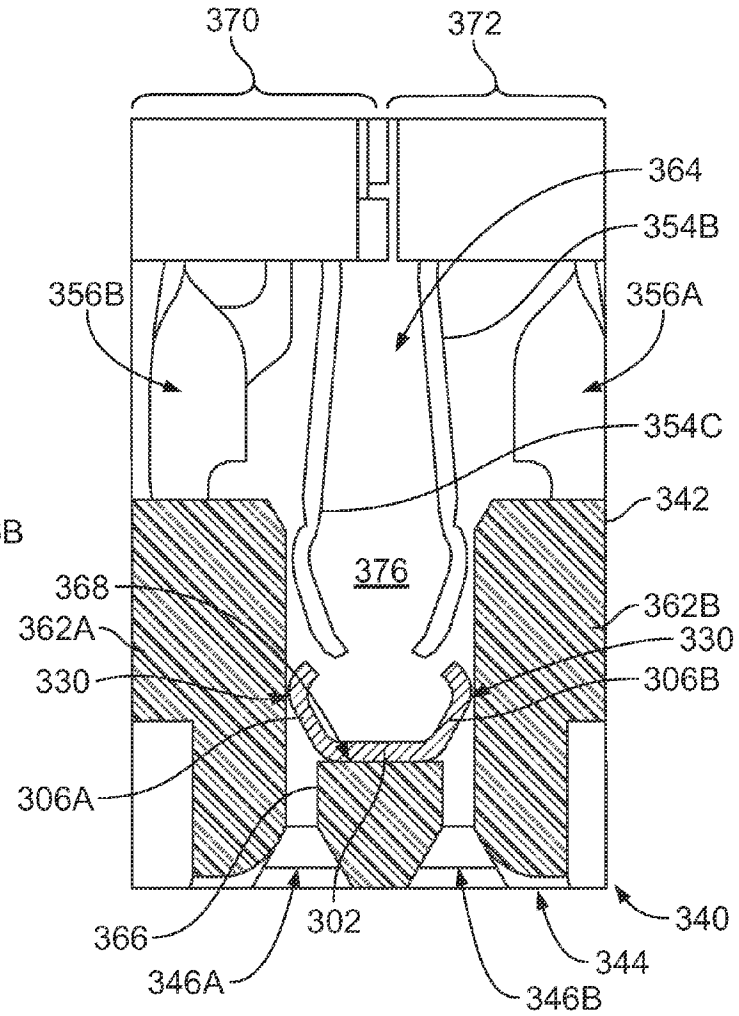
FIG. 8 is another enlarged cross-sectional view of the receptacle connector of FIG. 6.
Figure 7:
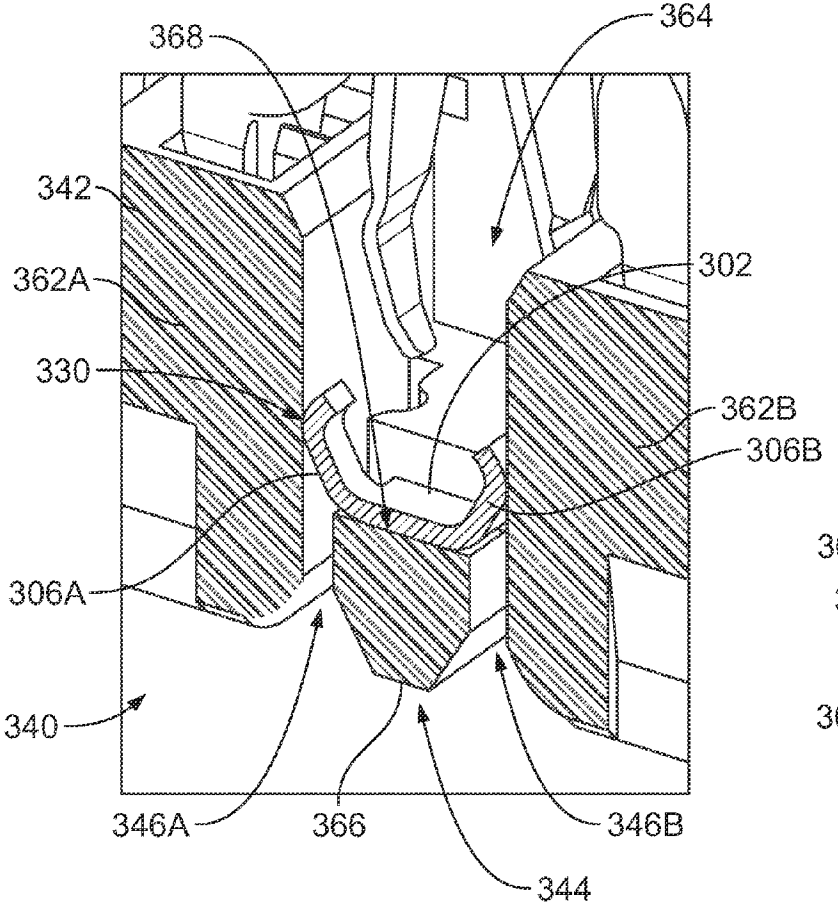
FIG. 7 is an enlarged cross-sectional view of the receptacle connector of FIG. 6 illustrating a portion of the grounding lattice within a connector housing of the receptacle connector.

FIGS. 7 and 8 are enlarged cross-sectional views of the receptacle connector 340 illustrating a portion of the grounding lattice 302 within the connector housing 342 in greater detail. As shown, the connector housing 342 includes dielectric blocks 362A, 362B that are separated by one of the housing walls 366. The connector housing 342 may define an interior contact cavity 364 that includes multiple ground passages 346A, 346B. The ground passage 346A is partially defined between the dielectric block 362A and the housing wall 366. The ground passage 346B is partially defined between the dielectric block 362B and the housing wall 366. The grounding lattice 302 engages a back side 368 of the housing wall 366. In an exemplary embodiment, the connector housing 342 is overmolded with the grounding lattice 302 such that the grounding lattice 302 is encased within the connector housing 342. The grounding lattice 302 is proximate to the front side 344 in the illustrated embodiment, but may be located at other depths in alternative embodiments.

As shown in FIGS. 7 and 8, the side lattice springs 306A, 306B are angled to engage the ground shields 410 (FIG. 10) when the ground shields 410 are inserted through the ground passages 346A, 346B. The side lattice springs 306A, 306B may be angled to extend away from the front side 344. The inflection areas 330 of the side lattice springs 306A, 306B may engage or be located immediately adjacent to the dielectric blocks 362A, 362B. In such embodiments, the ground shields 410 may engage the side lattice springs 306A, 306B during the mating operation.

Also shown in FIG. 8, the receptacle connector 340 includes adjacent contact modules 370, 372. In an exemplary embodiment, each contact module 370, 372 includes a pair of the signal contacts 356A, 356B and a plurality of the ground contacts 354A (FIG. 6), 354B, 354C. However, FIG. 8 only shows portions of the contact modules 370, 372. As such, only the signal contact 356B and the ground contact 354C of the contact module 370 are shown, and only the signal contact 356A and the ground contact 354B of the contact module 372 are shown.

The ground contact 354C of the contact module 370 and the ground contact 354B of the contact module 372 extend into a cavity portion 376 of the contact cavity 364 between the dielectric blocks 362A, 362B. The ground contact 354C of the contact module 370 and the ground contact 354B of the contact module 372 are aligned with the ground passages 346A, 346B, respectively. The ground contacts 354B and 354C may be electrically coupled to shield assemblies (not shown) of the contact modules 372, 370, respectively. Such shield assemblies may be similar to the shield assembly 220 (FIG. 4).

When the separate ground shields 410 (FIG. 10) are inserted into the corresponding ground passages 346A, 346B, the side lattice springs 306A, 306B engage the respective ground shields 410 and are deflected by the respective ground shields 410 toward each other. The ground shields 410 may then engage and deflect the ground contacts 354C, 354B. In an exemplary embodiment, the ground contacts 354C, 354B are deflected generally toward each other.

Figure 9:
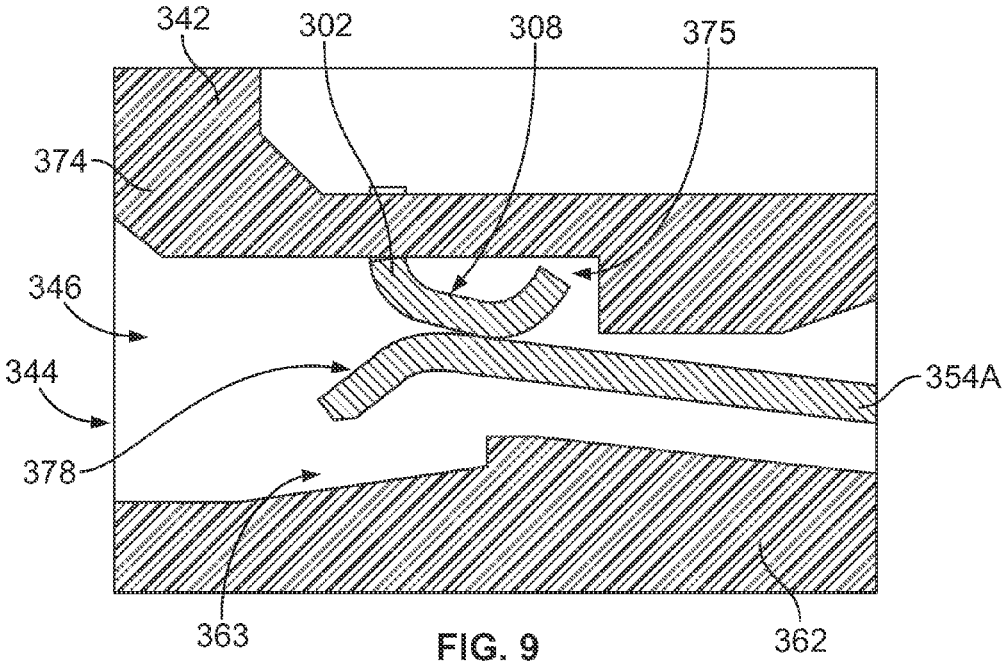
FIG. 9 is a side cross-sectional view of a lattice spring of the grounding lattice and a ground contact of the receptacle connector located within a contact passage of the connector housing.

FIG. 9 is a side cross-section of the connector housing 342 illustrating an exemplary ground passage 346 that is defined between one of the dielectric blocks 362 and the housing wall 374. As shown, the ground contact 354A and the wall lattice spring 308 of the grounding lattice 302 may extend into the ground passage 346 and engage each other therein. The wall lattice spring 308 is angled away from the front side 344 and is configured to engage an outer surface 428 (shown in FIG. 10) of the ground shield 410 (FIG. 10). The ground contact 354A includes a distal portion 378 that is configured to engage an inner surface 426 (shown in FIG. 10) of the ground shield 410. The distal portion 378 has a curved contour such that the ground shield 410 does not snag or stub the ground contact 354A when the ground shield 410 is inserted into the ground passage 346. When the ground shield 410 is inserted into the ground passage 346, the ground shield 410 engages each of the ground contact 354A and the wall lattice spring 308. The ground contact 354A and the wall lattice spring 308 are deflected away from each other and the ground shield 410 slides therebetween. In the illustrated embodiment, the dielectric block 362 and the housing wall 374 are shaped to include respective recesses 363, 375 that permit the ground contact 354A and the wall lattice spring 308, respectively, to move therein.

FIG. 10 is a cross-section of the connector housing 342 taken transverse to the mating axis 391 (FIG. 6) having the ground shield 410 inserted into the ground passage 346 after the receptacle connector 340 (FIG. 6) and the system connector 402 (FIG. 11) have been mated. As shown, the signal contacts 432 of the system connector 402 are inserted into the signal passages 348. The ground shield 410 includes the inner surface 426 and the outer surface 428 and defines shield walls 421, 422, 423. When the receptacle and header connector 340, 402 are fully mated, the ground shield 410 engages each of the ground contacts 354A-354C and engages each of the side lattice springs 306A, 306B and the wall lattice spring 308. More specifically, the ground contact 354A engages the shield wall 422 along the inner surface 426, and the wall lattice spring 308 engages the shield wall 422 along the outer surface 428. The shield wall 421 engages the side lattice spring 306B and the ground contact 354B along the outer surface 428, and the shield wall 423 engages the side lattice spring 306A and the ground contact 354C along the outer surface 428. Accordingly, each of the shield walls 421-423 engages one of the ground contacts 354A-354C and one of the lattice springs 306A, 306B, 308 of the grounding lattice 302.

FIG. 11 is a side cross-section of a portion of a communication system 400 that includes the system connector 402 and the receptacle connector 340 when fully mated. The communication system 400 also includes a circuit board 406 having the system connector 402 mounted thereto. As shown in FIG. 11, the connector housing 342 includes a loading side 382 that interfaces with the contact module 372. The front side 344 and the loading side 382 face in opposite directions along the mating axis 391. The grounding lattice 302 is located within the connector housing 342 between the front and loading sides 344, 382. During the mating operation, the ground shields 410 are inserted through the corresponding ground passages 346 of the connector housing 342 in the mating direction 315.

The system connector 402 includes a connector housing 404 having a mounting wall 405 that interfaces with the circuit board 406. The connector housing 404 may be similar or identical to the connector housings 117, 119 (FIG. 1), and the circuit board 406 may be similar or identical to the circuit board 110 (FIG. 1). The circuit board 406 includes a plurality of plated thru-holes (or vias) 409 and a ground plane 408 that is electrically coupled to the plated thru-holes 409.

The system connector 402 also includes a two-dimensional shield array 380 of the ground shields 410. Like the contact array 125 (FIG. 1), the shield array 380 may extend along the first and second lateral axes 392, 393. Each of the ground shields 410 includes a shield body 412 that extends lengthwise along the mating axis 391 between a leading edge 414 and a trailing edge 416 of the corresponding ground shield 410. In the illustrated embodiment, the trailing edge 416 is located within the mounting wall 405 of the connector housing 404. In other embodiments, the trailing edge 416 may directly interface with the circuit board 406.

The shield body 412 includes the shield walls 421 (FIG. 10), 422, 423. Each of the ground shields 410 also includes at least one shield tail 418 that is coupled to the shield body 412. The shield tail 418 projects from the trailing edge 416 of the corresponding shield body 412 and includes a compliant pin 419. As shown, the shield tails 418 are inserted into the thru-holes 409 of the circuit board 406 and the compliant pins 419 mechanically and electrically engage the circuit board 406. In an exemplary embodiment, the compliant pins 419 are eye-of-needle (EON) pins that are compressed by the thru-holes 409 of the circuit board 406 when the compliant pins 419 are inserted therein. As such, the ground shields 410 are electrically coupled to the ground plane 408 of the circuit board 406.

Each of the shield bodies 412 has a body length 430 that is measured between the trailing edge 416 and the leading edge 414 of the corresponding shield body 412 along the mating axis 391. The shield tail 418 has a cross-sectional area taken transverse to the mating axis 391 that is different than a cross-sectional area of the shield body 412. In such embodiments, the change in cross-sectional area may form a reflection or choke region 434 within the ground shield 410.

During operation of the communication system 400, electrical energy may be reflected within the shield body 412 proximate to the reflection region 434. More specifically, as the ground shield 410 transitions between the trailing edge 416 and the shield tail 418, the reduction in cross-sectional area may cause the electrical energy to reflect within the shield body 412. Without the grounding lattice 302, the electrical energy may resonate at a frequency and magnitude that is based, in part, on the body length 430. Under certain circumstances, such electrical resonance may negatively affect the signal integrity of the signals propagating through the signal contacts 432 (FIG. 10). When the grounding lattice 302 electrically commons the ground shields 410, however, the frequency at which the electrical energy resonates may be changed and the magnitude may be reduced. In such embodiments, the negative effects on the signals may be reduced and, accordingly, the signal integrity may be improved.

The electrical performance may be based, in part, on longitudinal locations at which the grounding lattice 302 engages the ground shields 410. For example, the wall lattice springs 308 engage the ground shields 410 at contact points $X_1$. The side lattice lattice springs 306A, 306B (FIG. 5) may engage the shield walls 423, 421, respectively, of the corresponding ground shields 410 at corresponding contacts points $X_2$ (indicated by dashed lines) As shown, the contact points $X_1$, $X_2$ are substantially coplanar. Collectively, the contact points $X_1$, $X_2$ between the ground shields 410 and the grounding lattice 302 are distributed along two dimensions or, more specifically, the first and second lateral axes 392, 393. As such, the ground shields 410 may be electrically commoned along two dimensions. In alternative embodiments, only one row of ground shields may be electrically commoned.

In some embodiments, the contact points $X_1$, $X_2$ are within a middle one-half (½) of the body length 430 (indicated by $Z_1$). More specifically, if the body length 430 was separated into quarters, the middle one-half $Z_1$ would represent a portion of the body length 430 that includes the second and third quarters of the body length 430. In other words, the middle one-half $Z_1$ begins at an end of a first quarter of the body length 430 and ends at a beginning of the fourth quarter of the body length 430. In particular embodiments, the contact points $X_1$, $X_2$ are within a middle one-third (⅓) of the body length 430 (indicated by $Z_2$). In more particular embodiments, the contact points $X_1$, $X_2$ are located at about the midpoint of the body length 430. However, the grounding lattice 302 may engage the ground shields 410 at other longitudinal locations with respect to the body length 430, such as proximate to the mounting wall 405 or proximate to a loading side 382 of the connector housing 342.

Accordingly, the grounding lattice 302 may electrically common the ground shields 410 of the two-dimensional shield array 380. The grounding lattice 302 may effectively change the frequency at which the electrical energy resonates within the ground shields 410 such that the electrical noise generated by the electrical energy does not significantly degrade signal quality of the communication system 400.

Figure 12:
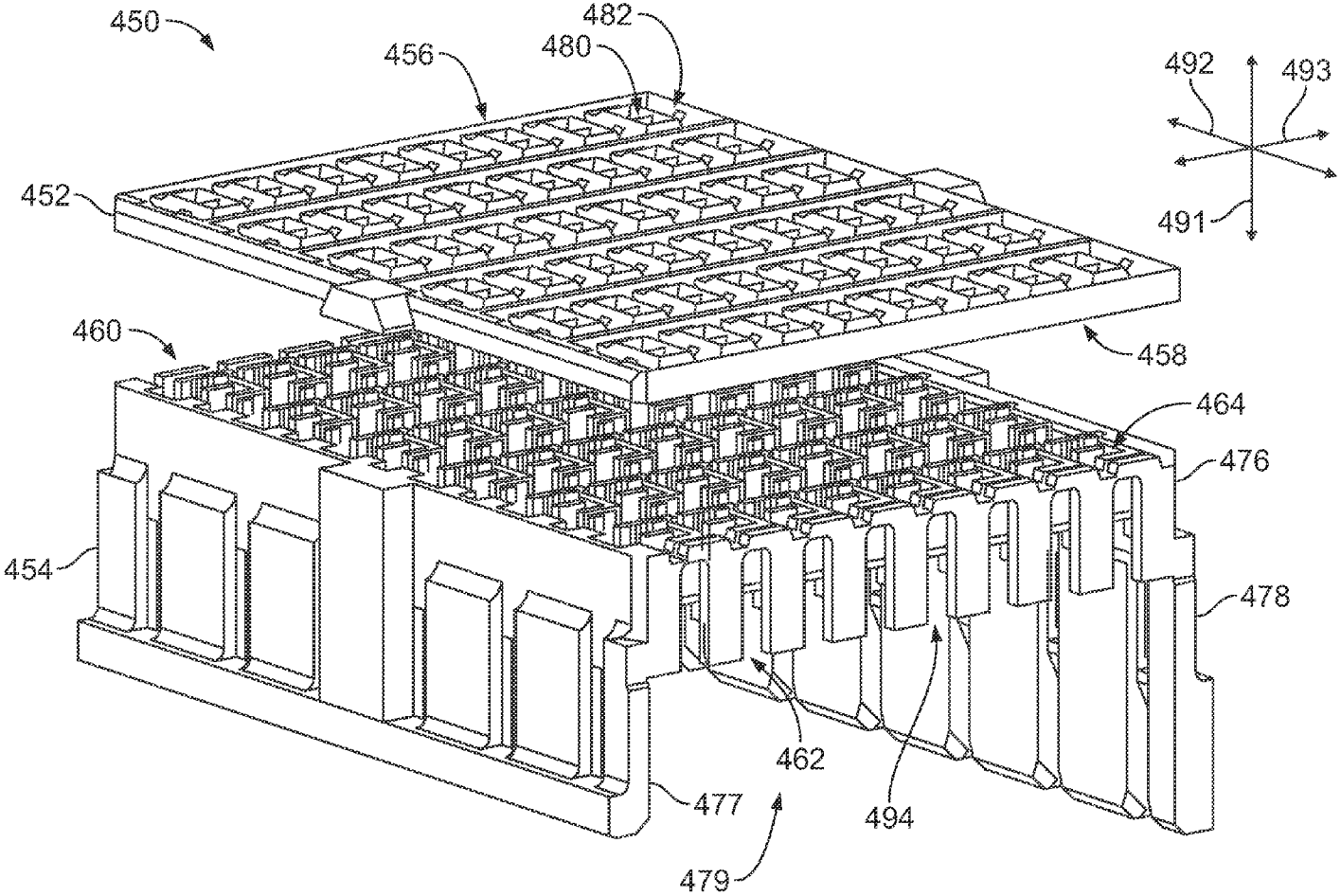
FIG. 12 is an exploded view of a connector housing formed in accordance with an embodiment.

FIG. 12 is a partially exploded view of a connector housing 450, which may be used with an electrical connector, such as the receptacle connector 340 (FIG. 6). In an exemplary embodiment, the connector housing 450 includes a cover portion 452 and a base portion 454 that are configured to removably couple to each other with a grounding lattice, such as the grounding lattice 302 (FIG. 5), therebetween. In alternative embodiments, the connector housing 450 may not have separable housing portions and, instead, may be molded as a single piece of material that includes the various features of the connector housing 450 described herein. In such embodiments, the connector housing 450 may be molded around the grounding lattice 302.

The connector housing 450 is oriented with respect to a mating axis 491 and first and second lateral axes 492, 493. In the illustrated embodiment, the cover portion 452 includes a front side 456 of the connector housing 450 and a back side 458 that face in opposite directions along the mating axis 491. The cover portion 452 includes contact passages 480, 482, which may be termed signal passages 480 and ground passages 482. The signal and ground passages 480, 482 extend between the front side 456 and the back side 458. The signal and ground passages 480, 482 open to the front side 456 and open to the back side 458.

The base portion 454 includes a cover side 460 and a loading side 462 that face in opposite directions along the mating axis 491. The base portion 454 includes contact cavities 464 that extend between the cover and loading sides 460, 462. The contact cavities 464 are configured to align with the signal and ground passages 480, 482 and receive signal contacts (not shown) from contact modules (not shown). For instance, the contact cavities 464 may be configured to receive the signal contacts 215 (FIG. 4) from the contact modules 160 (FIG. 1).

The cover portion 452 and the base portion 454 may be shaped to include complementary features, such as projections and cavities, that engage each other through a frictional engagement (or an interference fit). For example, the base portion 454 includes recesses 476 that open to the cover side 460. The recesses 476 may be sized and shaped to receive corresponding elements of the grounding lattice 302 and/or corresponding elements of the cover portion 452. Alternatively or in addition to the frictional engagement, an adhesive may be applied to the cover side 460 of the base portion 454 and/or the back side 458 of the cover portion 452 to secure the cover portion 452 to the base portion 454. When the cover portion 452 is operably coupled to the base portion 454, each of the signal and ground passages 480, 482 may align with one or more of the contact cavities 464.

Also shown in FIG. 12, the base portion 454 may include shroud walls 477, 478 that extend in a rearward direction away from the loading side 462. The shroud walls 477, 478 may oppose each other to define a module-receiving space 479 therebetween. The module-receiving space 479 is configured to receive the contact modules (not shown) therebetween. The base portion 454 may also include loading slots 494 that are sized and shaped to receive corresponding contact modules 160. The loading slots 494 may guide the contact modules as the contact modules are moved along the mating axis 491 so that the signal contacts (not shown) and the ground contacts (not shown) are received within the corresponding contact cavities 464.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a connector housing having a front side that faces along a mating axis and contact passages that open to the front side, the contact passages configured to receive corresponding ground shields of a system connector during a mating operation;

signal contacts coupled to the connector housing and configured to engage corresponding contacts of the system connector; and a grounding lattice held by the connector housing, the grounding lattice including a support frame and lattice springs that are interconnected by the support frame, the support frame extending generally transverse to the mating axis, the lattice springs being positioned to engage the ground shields of the system connector as the ground shields are inserted into the corresponding contact passages of the connector housing, wherein the grounding lattice is separate from other conductive elements of the electrical connector when the electrical connector and the system connector are mated.

2. The electrical connector of claim 1, wherein the connector housing has a loading side that is generally opposite the front side, the support frame being encased within the connector housing between the front and loading sides.

3. The electrical connector of claim 1, wherein the connector housing includes a cover portion and a base portion that are discrete with respect to each other, the cover portion including the front side, wherein the grounding lattice is positioned between the cover and base portions, the base portion separating the grounding lattice from other conductive elements of the electrical connector.

4. The electrical connector of claim 1, wherein the contact passages form a two-dimensional passage array, the support frame including links that define a two-dimensional array of openings in which each opening is entirely surrounded by corresponding links, the lattice springs extending from the links, the grounding lattice configured to electrically ground a two-dimensional shield array of the ground shields when the electrical connector and the system connector are mated.

5. The electrical connector of claim 1, wherein the grounding lattice is electrically isolated from other conductive elements of the electrical connector when the electrical connector and the system connector are not mated.

6. The electrical connector of claim 1, wherein the contact passages include ground passages and signal passages, each ground passage being shaped to surround a corresponding pair of the signal passages, the signal contacts being positioned within corresponding signal passages.

7. The electrical connector of claim 1, wherein the grounding lattice is stamped-and-formed from sheet metal or formed from a dielectric frame having a conductive plating.

8. The electrical connector of claim 1, further comprising signal conductors and a shield assembly that extends along the signal conductors, the shield assembly including ground contacts, each of the ground contacts configured to engage corresponding ground shields of the system connector when the system connector and the electrical connector are mated.

9. The electrical connector of claim 1, wherein the grounding lattice is configured to change a resonating frequency of electrical energy that resonates along the ground shields of the system connector to reduce electrical noise when the electrical connector and the system connector are mated.

10. The electrical connector of claim 1, wherein the support frame includes links that define openings of the grounding lattice, each of the openings being entirely surrounded by corresponding links, the lattice springs extending from the links, wherein at least some of the openings are associated with corresponding groups of the lattice springs, each of the groups including first, second, and third lattice springs, the first lattice spring facing in a direction along a first lateral axis, the second and third lattice springs facing in opposite directions along a second lateral axis, the first, second, and third lattice springs configured to engage the same ground shield.

11. The electrical connector of claim 1, wherein the grounding lattice is electrically isolated from the other conductive elements of the electrical connector when the electrical connector and the system connector are mated, except for being indirectly coupled to the other conductive elements through the ground shields.

12. A communication system comprising:

a first electrical connector comprising a contact array including first signal contacts and ground shields positioned between the first signal contacts; and a second electrical connector including a connector housing having a front side that faces along a mating axis and contact passages that open to the front side, the second electrical connector including second signal contacts and a grounding lattice that is held by the connector housing of the second electrical connector, the grounding lattice extending generally transverse to the mating axis;

wherein the first signal contacts and the second signal contacts engage one another when the first and second electrical connectors are mated to form signal pathways, the ground shields being received within the contact passages and the grounding lattice engaging the ground shields to electrically common the ground shields when the first and second electrical connectors are mated, wherein the grounding lattice is separate from other conductive elements of the second electrical connector when the second electrical connector and the first electrical connector are mated.

13. The communication system of claim 12, wherein the ground shields include shield bodies that have respective body lengths measured along the mating axis, each of the body lengths being measured between a leading edge and a trailing edge of the corresponding shield body, the grounding lattice engaging the shield bodies within a middle one-half (½) of the body length.

14. The communication system of claim 12, further comprising first and second connector systems, the first connector system including a first circuit board having the first electrical connector mounted thereto, the second connector system including a second circuit board having the second electrical connector mounted thereto, wherein the communication system is a backplane or midplane communication system.

15. The communication system of claim 12, wherein the connector housing of the second electrical connector has a loading side that is opposite the front side of the connector housing, the grounding lattice including a support frame and lattice springs that are interconnected by the support frame and that engage the ground shields, the support frame being encased within the connector housing between the front and loading sides.

16. The communication system of claim 12, wherein the connector housing of the second electrical connector includes a cover portion and a base portion that are discrete with respect to each other, the cover portion including the front side of the connector housing, wherein the grounding lattice is positioned between the cover and base portions, the base portion separating the grounding lattice from other conductive elements of the electrical connector.

17. The communication system of claim 12, wherein the grounding lattice is configured to change a resonating frequency of electrical energy that resonates along the ground shields of the first electrical connector to reduce electrical noise when the first and second electrical connectors are mated.

18. An electrical connector comprising:

a connector housing having a front side and contact passages that open to the front side, the contact passages configured to receive corresponding ground shields of a system connector during a mating operation;

contact sub-assemblies including signal contacts and ground contacts, the signal contacts configured to engage corresponding contacts of the system connector, the ground contacts being positioned within corresponding contact passages and configured to engage the corresponding ground shields during the mating operation, wherein each of the contact sub-assemblies includes a pair of the signal contacts and at least one of the ground contacts that is positioned proximate to the pair of the signal contacts; and a grounding lattice held by the connector housing and extending generally parallel to the front side, the grounding lattice engaging the ground shields within the corresponding contact passages when the system connector and the electrical connector are mated to electrically common the ground shields;

wherein the connector housing includes a cover portion and a base portion that are separable from each other, the cover portion including the front side, wherein the grounding lattice is positioned between the cover portion and the base portion, and wherein the base portion has a loading side of the connector housing that interfaces with the contact modules and a cover side that interfaces with the grounding lattice, the front side and the loading side facing in generally opposite directions, the base portion separating the grounding lattice from the other conductive elements of the contact modules.

19. The electrical connector of claim 18, wherein the grounding lattice includes a support frame and lattice springs that are interconnected by the support frame, the support frame includes links that define openings of the grounding lattice, each of the openings being entirely surrounded by corresponding links, the lattice springs extending from the links, wherein at least some of the openings are associated with corresponding groups of the lattice springs, each of the groups including first, second, and third lattice springs, the first lattice spring facing in a direction along a first lateral axis, the second and third lattice springs facing in opposite directions along a second lateral axis, the first, second, and third lattice springs configured to engage the same ground shield.

* * * * *